US009138863B2

(12) United States Patent
Schubert et al.

(10) Patent No.: US 9,138,863 B2
(45) Date of Patent: Sep. 22, 2015

(54) PARTICLE-DELIVERY IN ABRASIVE-JET SYSTEMS

(75) Inventors: Ernst H. Schubert, Snoqualmie Pass, WA (US); Erik M. Unangst, Kent, WA (US)

(73) Assignee: OMAX Corporation, Kent, WA (US)

( * ) Notice: Subject to any disclaimer, the term of this patent is extended or adjusted under 35 U.S.C. 154(b) by 657 days.

(21) Appl. No.: 13/436,459

(22) Filed: Mar. 30, 2012

(65) Prior Publication Data

US 2012/0252326 A1 Oct. 4, 2012

Related U.S. Application Data

(60) Provisional application No. 61/471,039, filed on Apr. 1, 2011.

(51) Int. Cl.

| | |
|---|---|
| ***B24C 7/00*** | (2006.01) |
| ***B24C 3/00*** | (2006.01) |
| ***B24C 1/04*** | (2006.01) |
| ***B24C 3/04*** | (2006.01) |

(52) U.S. Cl.

CPC . *B24C 1/045* (2013.01); *B24C 3/04* (2013.01); *B24C 7/003* (2013.01); *B24C 7/0007* (2013.01); *B24C 7/0038* (2013.01); *B24C 7/0084* (2013.01)

(58) Field of Classification Search

CPC ..... B24C 1/045; B24C 3/04; B24C 7/0084; B24C 7/003; B24C 7/0038; B24C 7/0007

USPC ..... 451/60, 446, 99

See application file for complete search history.

(56) References Cited

U.S. PATENT DOCUMENTS

| | | | | |
|---|---|---|---|---|
| 3,073,070 | A * | 1/1963 | Mead | 451/2 |
| 3,413,794 | A | 12/1968 | Bell et al. | |
| 3,543,444 | A | 12/1970 | Mehta | |
| 3,834,082 | A | 9/1974 | Grudzinski | |

(Continued)

FOREIGN PATENT DOCUMENTS

GB 2198975 A 6/1988

OTHER PUBLICATIONS

U.S. Appl. No. 13/436,354, filed Mar. 30, 2012, Schubert et al.

(Continued)

*Primary Examiner* — Lee D Wilson
*Assistant Examiner* — Joel Crandall
(74) *Attorney, Agent, or Firm* — Perkins Coie LLP

(57) ABSTRACT

Particle-delivery devices, abrasive jet systems, and associated devices, systems, and methods are disclosed herein. In certain aspects, the particle-delivery devices can include an elongated fluidizing chamber and a metering assembly. The metering assembly can include a particle flow path extending from the fluidizing chamber. The metering assembly can also include a carrier-gas passage extending to an injection orifice proximate the fluidizing chamber. The metering assembly can be configured to inject carrier gas into the fluidizing chamber to fluidize particles within the fluidizing chamber. Fluidizing the particles at different carrier-gas pressures and/or flow rates can change the rate of particle delivery. For example, the metering assembly can include a metering opening and a regulator configured to change a steady-state pressure and/or flow rate of carrier gas entering the fluidizing chamber. Systems disclosed herein can include a controller configured to change a flow rate of particles through the metering opening.

32 Claims, 9 Drawing Sheets

(56) References Cited

U.S. PATENT DOCUMENTS

| | | | | | |
|---|---|---|---|---|---|
| 4,075,789 | A | | 2/1978 | Dremann | |
| 4,125,969 | A | * | 11/1978 | Easton | 451/39 |
| 4,253,610 | A | * | 3/1981 | Larkin | 239/430 |
| 4,478,368 | A | * | 10/1984 | Yie | 239/430 |
| 4,545,157 | A | * | 10/1985 | Saurwein | 451/102 |
| 4,802,312 | A | * | 2/1989 | Glaeser et al. | 451/38 |
| 4,878,320 | A | | 11/1989 | Woodson | |
| 4,984,397 | A | | 1/1991 | Van Leeuwen | |
| 5,018,670 | A | * | 5/1991 | Chalmers | 239/433 |
| 5,098,229 | A | | 3/1992 | Meier et al. | |
| 5,107,630 | A | | 4/1992 | Lodewijk | |
| 5,407,379 | A | | 4/1995 | Shank et al. | |
| 5,441,441 | A | | 8/1995 | Cook et al. | |
| 5,468,066 | A | | 11/1995 | Hammonds | |
| 5,591,064 | A | | 1/1997 | Spears, Jr. | |
| 5,643,058 | A | | 7/1997 | Erichsen et al. | |
| 5,800,246 | A | | 9/1998 | Tomioka | |
| 5,876,267 | A | * | 3/1999 | Kanda | 451/38 |
| 6,083,001 | A | | 7/2000 | Deardon et al. | |
| 6,098,677 | A | | 8/2000 | Wegman et al. | |
| 6,200,203 | B1 | | 3/2001 | Xu et al. | |
| 6,227,768 | B1 | | 5/2001 | Higuchi et al. | |
| 6,425,804 | B1 | | 7/2002 | Pettit et al. | |
| 6,676,039 | B2 | | 1/2004 | Lindsey et al. | |
| 7,040,959 | B1 | | 5/2006 | Panuska et al. | |
| 7,465,215 | B2 | | 12/2008 | Shimizu et al. | |
| 8,123,591 | B2 | | 2/2012 | Olsen | |
| 8,308,525 | B2 | | 11/2012 | Hashish et al. | |
| 8,342,912 | B2 | | 1/2013 | Funatsu et al. | |
| 2001/0046833 | A1 | * | 11/2001 | Hashish et al. | 451/101 |
| 2003/0166378 | A1 | | 9/2003 | Fuksshimov et al. | |
| 2004/0132383 | A1 | | 7/2004 | Langford et al. | |
| 2005/0017091 | A1 | | 1/2005 | Olsen et al. | |
| 2005/0070205 | A1 | | 3/2005 | Korovin et al. | |
| 2005/0239371 | A1 | | 10/2005 | Togawa | |
| 2012/0021676 | A1 | | 1/2012 | Schubert et al. | |
| 2012/0156969 | A1 | | 6/2012 | Liu | |
| 2012/0196516 | A1 | | 8/2012 | Funatsu et al. | |
| 2012/0252325 | A1 | | 10/2012 | Schubert et al. | |
| 2013/0005225 | A1 | | 1/2013 | Russo | |
| 2013/0267152 | A1 | | 10/2013 | Tera et al. | |
| 2014/0045409 | A1 | | 2/2014 | Zhang et al. | |

OTHER PUBLICATIONS

U.S. Appl. No. 13/645,933, filed Oct. 5, 2012, Zhang et al.
Operation Manual, Abrasive Delivery System, Type ADS-24-II, © Flow Europe GmbH Jul. 2000, 28 pages.

* cited by examiner

PARTICLE-DELIVERY IN ABRASIVE-JET SYSTEMS

CROSS REFERENCE TO RELATED APPLICATION

This disclosure claims the benefit of U.S. Provisional Application No. 61/471,039, filed Apr. 1, 2011, entitled "SYSTEMS AND METHODS FOR FLUIDIZING AN ABRASIVE MATERIAL," which is incorporated herein by reference in its entirety. This disclosure also incorporates by reference in its entirety U.S. patent application Ser. No. 13/436,354, entitled "SYSTEMS AND METHODS FOR FLUIDIZING AN ABRASIVE MATERIAL," filed Mar. 30, 2012.

TECHNICAL FIELD

The present technology relates to particle delivery, such as particle delivery in abrasive-jet systems. In particular, several embodiments are directed to particle-delivery devices configured to control a flow rate of particle delivery by controlling a pressure and/or a flow rate of a fluidizing carrier gas as well as associated devices, systems, and methods.

BACKGROUND

Waterjet systems typically are configured to produce a high-velocity jet of water or another suitable fluid that can be directed toward a workpiece to rapidly erode portions of the workpiece. This technology can be used in precision cutting, shaping, carving, and reaming, among other applications. Abrasive particles can be added to a waterjet fluid to increase the rate of erosion. When abrasive is present, a waterjet system can be referred to as an abrasive-waterjet system or as an abrasive-jet system. In comparison to other precision machining technologies, e.g., grinding and plasma cutting, abrasive-jet systems can have certain advantages. For example, abrasive jet systems often produce particularly fine and clean cuts, typically without a heat-affected zone around the cut. Abrasive-jet systems also can be highly versatile with respect to the material type of the workpiece. The range of materials that can be processed using abrasive-jet technology includes very soft materials, e.g., rubber, foam, leather, and paper, as well as very hard materials, e.g., stone and metal.

Abrasive-jet systems can include pumps capable of pressurizing fluid to extremely high pressures, e.g., 40,000 to 100,000 psi or more. This can be accomplished, for example, using an electric radial-displacement pump that pressurizes hydraulic oil that, in turn, drives an intensifier pump. High-pressure fluid from the intensifier pump can be routed to a cutting head where it can pass through an orifice toward a workpiece. The orifice can be configured to convert static pressure of the fluid into kinetic energy such that the fluid exits the office at extremely high speed, e.g., up to 2,500 feet-per-second or more. The orifice typically is a hard jewel, e.g., a synthetic sapphire, ruby, or diamond, held in an orifice mount. Waste from an abrasive jet process can be minimal. In many cases, very little smoke or dust is generated during operation of an abrasive jet system. Moreover, the fluid and abrasive often can be recycled. In some abrasive jet processes, a workpiece is mounted in a suitable jig and the jig and/or the cutting head is moved under computer or robotic control. In this way, highly complex processing can be executed automatically.

BRIEF DESCRIPTION OF THE DRAWINGS

Many aspects of the present disclosure can be better understood with reference to the following drawings. The components in the drawings are not necessarily to scale. Instead, emphasis is placed on illustrating clearly the principles of the present disclosure. In the drawings, like reference numerals designate corresponding parts throughout the several views.

DETAILED DESCRIPTION

Figure 1:
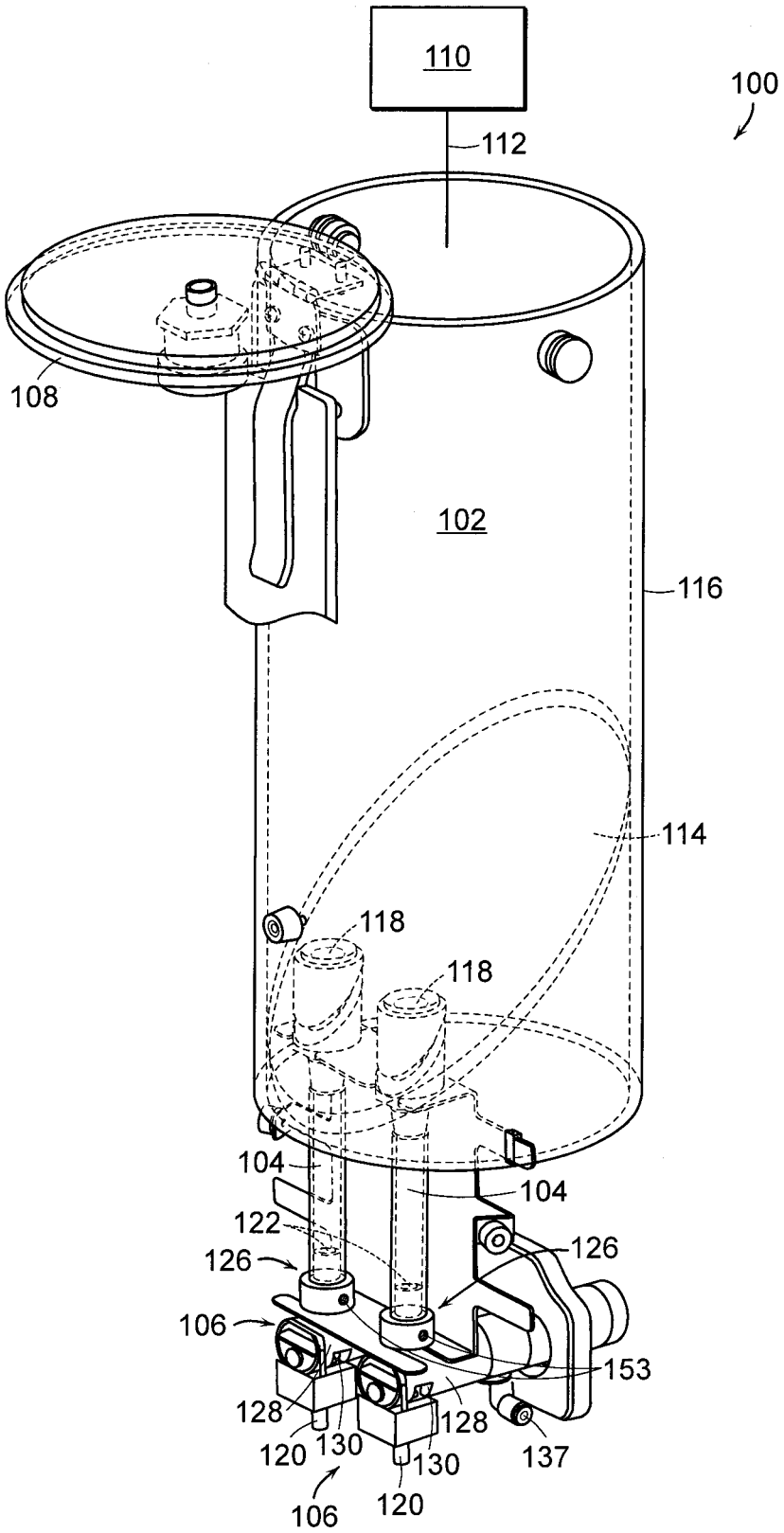
FIG. 1 is a perspective view of a particle-delivery device of an abrasive jet system configured in accordance with an embodiment of the present technology and having two elongated fluidizing chambers extending between a particle-supply chamber and two metering assemblies.

Specific details of several embodiments of the present technology are disclosed herein with reference to FIGS. 1-9. Although many of the embodiments are disclosed herein with respect to abrasive-jet applications, other applications and other embodiments in addition to those disclosed herein are within the scope of the present technology. For example, particle-delivery devices configured in accordance with embodiments of the present technology can be useful in some gas-entrained particle blasting applications. Embodiments of the present technology can have different configurations, components, or procedures than those disclosed herein. Moreover, a person of ordinary skill in the art will understand that the other embodiments can have elements in addition to those shown and described herein and that the other embodiments can be without several of the elements shown and described herein without deviating from the present technology. For ease of reference, throughout this disclosure identical reference numbers are used to identify similar or analogous components or features, but the use of the same reference number does not imply that the components or features should be construed to be identical. Indeed, in many examples disclosed herein, the identically-numbered components or features are distinct in structure and/or function.

In addition, abrasive-jet systems as disclosed herein can be used with a variety of suitable working fluids or liquids to form a jet. More specifically, abrasive-jet systems configured in accordance with embodiments of the present technology can include working fluids such as water, aqueous solutions, paraffins, oils (e.g., mineral oils, vegetable oil, palm oil, etc.), glycol, liquid nitrogen, and other suitable abrasive jet fluids. As such, the term "water jet" or "waterjet" as used herein may refer to a jet formed by any working fluid associated with the corresponding abrasive-jet system, and is not limited exclusively to water or aqueous solutions. In addition, although several embodiments of the present disclosure may be described below with reference to water, other suitable working fluids can be used with any of the embodiments disclosed herein. Moreover, abrasive-jet systems as disclosed herein can also be used with a variety of pressurized gas sources and particulate or abrasive sources to affect or influence the abrasive jet. For example, abrasive-jet systems configured in accordance with embodiments of the present technology can include pressurized gases such as air, nitrogen, or oxygen, among others.

In the context of abrasive jet systems, it can be useful to deliver abrasive particles in a consistent and reliable manner. Variations in particle flow rate or brief or prolonged interruptions in particle delivery can cause costly equipment downtime, processing errors, scrapped workpieces, and other undesirable results. Processing using an abrasive jet system typically is executed according to precise computerized instructions. If the rate of material erosion changes spontaneously during execution of such instructions, e.g., due to inconsistent and/or unreliable particle delivery, a workpiece may be inadequately processed. For example, portions of a cut in a workpiece may be incomplete. Monitoring and correcting such errors can undermine the efficiency of automated production. Furthermore, even briefly subjecting some materials (e.g., tempered glass and layered composites) to a jet without sufficient abrasive content can cause blunted pressure on the material, which can cause undesirable cracking, chipping, or delamination. The technical challenges and operational demands of particle delivery, including the complex physics of particle flow, the abrasive effect of some particles on system components, and the need for versatility, have been inadequately addressed to at least some extent in conventional particle-delivery devices.

Some conventional abrasive-jet systems mix abrasive particles into a fluid to form a slurry before pressurizing the slurry into a jet. This approach simplifies achieving consistent and reliable abrasive-particle content in the abrasive jet, but can cause excessive wear on internal components as the slurry is pressurized. In an alternative approach, abrasive particles can be entrained in a fluid jet just prior to deployment of the jet against a workpiece. In this approach, a Venturi effect associated with the jet can draw abrasive particles into a mixing chamber along the flow path of the jet. When executed properly, this manner of incorporating particles into a jet can be partially self-metering, such that replenishment of particles in the mixing chamber closely matches particle consumption. The associated equilibrium of particle replenishment and consumption, however, can be sensitive to variations in the particle source upstream from the mixing chamber. In some applications, a large hopper with a direct gravity connection to a mixing chamber is ill-suited for consistent and reliable particle delivery. Large agglomerations of particles can be subject to clumping, rat holes, and other phenomena that can cause variability in and/or loss of particle-flow characteristics. These phenomena can be related to friction between the particles and can be dependent on particle size. For example, most disadvantageous particle behavior is exacerbated in agglomerations of smaller particles.

Particle-delivery devices configured in accordance with embodiments of the present technology, including those described in detail below, can be configured for use with particles of a variety of suitable types and sizes. For example, in the context of abrasive-jet systems, use of smaller particles may be desirable when the size of an abrasive jet is smaller, e.g., in micromachining applications, or when an application calls for minimal surface roughness around a cut. Conversely, use of larger particles may be desirable when cutting particularly hard materials or when a rapid rate of material removal is paramount. Suitable particle sizes include mesh sizes from about #36 to about #320, as well as other smaller and larger sizes. Particles having different compositions also can be used according to the requirements of different applications. Examples of suitable abrasive-particle materials include garnet, aluminum oxide, silicon carbide, and sodium bicarbonate, among others.

Abrasive-jet systems can have different settings corresponding to different abrasive-jet properties and different rates of particle consumption. This variability can further complicate consistent and reliable particle delivery. Conventional approaches to variable-rate particle delivery include variable-speed vibratory feeders, variable-speed augers, and gravity-drop devices with interchangeable outlet openings having different sizes. These approaches typically involve moving parts that can be highly susceptible to wear and jamming in an abrasive environment. The precision of these approaches can also be limited. Gravity feeding with interchangeable outlet openings having different sizes is perhaps the most precise conventional approach to variable-rate particle delivery, but space constraints can limit the range of available outlet-opening sizes and cause this approach to have an excessively limited range of particle-delivery rates. This approach also disadvantageously provides coarse-incremental rather than fine-incremental or infinite variability within the available range of particle-delivery rates.

Particle-delivery devices configured in accordance with embodiments of the present technology can overcome certain disadvantages of conventional particle-delivery devices. Some embodiments are configured to inject carrier gas into bulk particles to fluidize the particles. Varying the steady-state pressure and/or steady-state flow rate of the carrier gas can regulate the rate of particle delivery reliably and with a high degree of precision. FIG. 1 is a perspective view of a particle-delivery device 100 configured in accordance with an embodiment of the present technology. The particle-delivery device 100 can include a particle-supply chamber 102 connected to two elongated fluidizing chambers 104. Each of the fluidizing chambers 104 can be connected to a corresponding metering assembly 106. Other embodiments can have a different number of pairs of fluidizing chambers 104 and corresponding metering assemblies 106, such as one, three, or four. As shown in FIG. 1, the particle-supply chamber 102 can include a lid 108. In some embodiments, the particle-supply chamber 102 is configured to operate at atmospheric pressure. Alternatively, the particle-supply chamber 102 can be configured to hold pressure and the lid 108 can be configured to form a pressure-tight seal when closed. For example, the lid 108 can include a gasket (not shown) and a lock (not shown). During operation, the particle-supply chamber 102 can contain bulk particles prior to delivery. The supply of particles in the particle-supply chamber 102 can be replenished as needed, e.g., periodically or continuously. For example, FIG. 1 schematically illustrates a particle source 110 and a conduit 112 extending between the particle source 110 and the particle-supply chamber 102. Particles can travel through the conduit 112, for example, by gravity or applied pressure. In some embodiments, the particle-supply chamber 102 is internal to a machine housing (not shown) and the particle source 110 is external to the machine housing.

The particle-supply chamber 102 can be a hopper with a tapered lower portion. For example, as shown in FIG. 1, the particle-supply chamber 102 can include a plate 114 set at an angle within a cylindrical housing 116. In other embodiments, the particle-supply chamber 102 can have another suitable shape. The fluidizing chambers 104 can be drop tubes or other conduits with corresponding inlet openings 118 proximate the particle-supply chamber 102. The shape of the tapered lower portion of the particle-supply chamber 102 can facilitate movement of particles toward the inlet openings 118. For example, as shown in FIG. 1, the inlet openings 118 can be gravity fed from the particle-supply chamber 102. Moreover, the metering assemblies 106 can be at opposite ends of the fluidizing chambers 104 from the inlet openings 118. In other embodiments, the metering assemblies 106 can connect to the fluidizing chambers 104 at lateral portions of the fluidizing chambers 104. For example, the fluidizing chambers 104 can have sealed ends (not shown) below connections to the metering assemblies 106. With reference again to FIG. 1, the metering assemblies 106 can include outlet conduits 120 configured to convey particles to a cutting head (not shown). In some embodiments, outlet conduits 120 from multiple metering assemblies 106 merge into a single conduit before reaching a cutting head.

Figure 2:
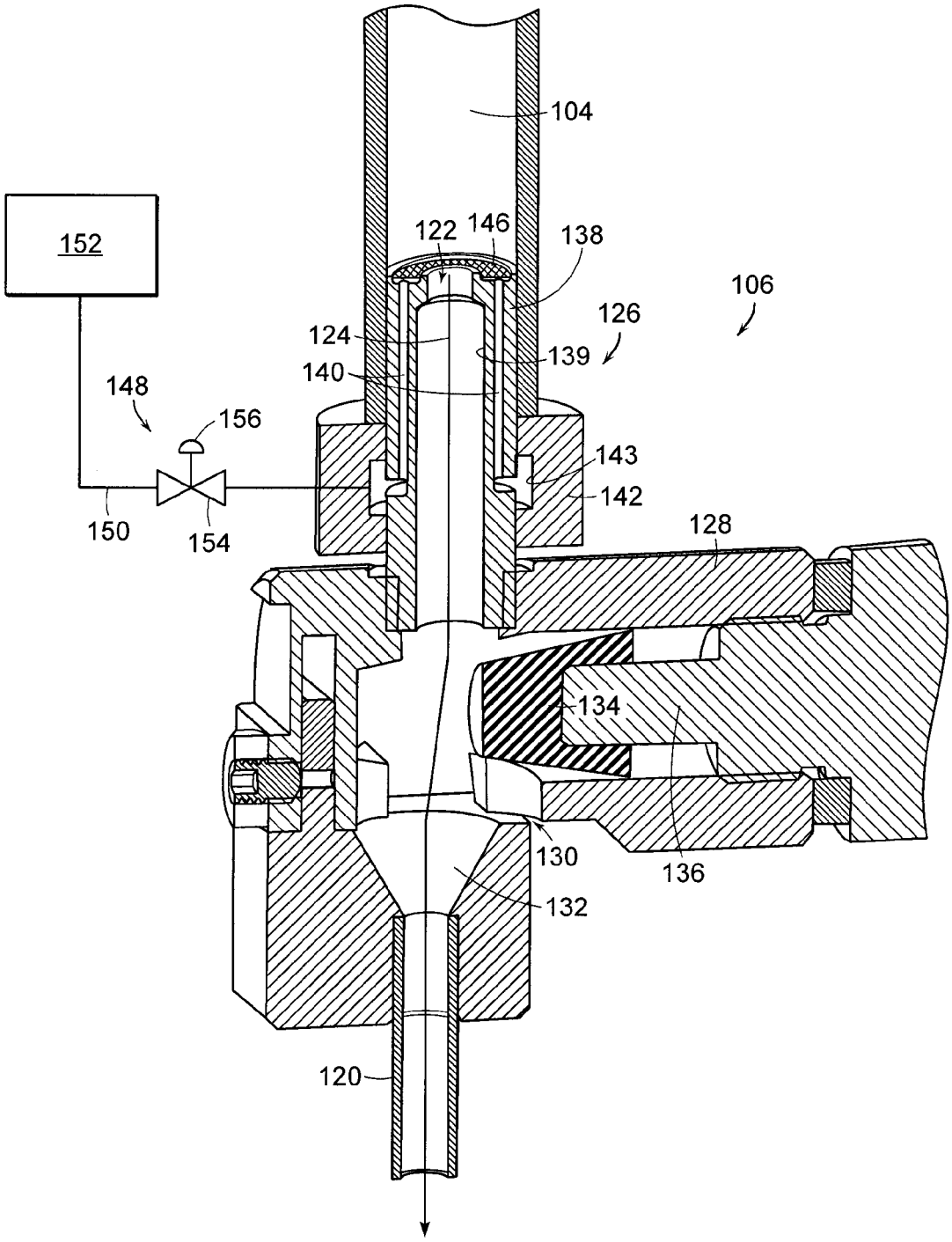
FIG. 2 is a cross-sectional perspective view of a metering assembly and a lower portion of a fluidizing chamber of the particle-delivery device shown in FIG. 1.

FIG. 2 is a cross-sectional perspective view of one of the metering assemblies 106 shown in FIG. 1 and a lower portion of the corresponding fluidizing chamber 104 shown in FIG. 1. As shown in FIG. 2, the metering assembly 106 can have a metering opening 122 proximate the fluidizing chamber 104. The metering opening 122 can be configured to convey particles in a fluidized and/or non-fluidized state from the fluidizing chamber 104. The metering opening 122 can be a fixed size, and, in some embodiments, there are generally no moving parts at the metering opening 122. This can reduce the possibility of jamming and prolong the life of the metering assembly 106 when used in an abrasive environment. The metering opening 122 can be configured to restrict particle delivery to some degree. For example, the metering opening 122 can be smaller than the inlet opening 118 (FIG. 1) of the fluidizing chamber 104. In some embodiments, the metering opening 122 is sized such that particles flow through the metering opening 122 by gravity at a rate corresponding to a baseline or minimum particle flow rate for the particle-delivery device 100. The metering opening 122 can have an inside area between about 0.01 $cm^2$ and about 0.03 $cm^2$. Other sizes are also possible, including smaller sizes suitable, e.g., for micromachining applications, and larger sizes suitable, e.g., for non-jet applications.

The metering assembly 106 can include elements configured to fluidize at least a portion of the particles within the fluidizing chamber 104. For example, as discussed in greater detail below, the metering assembly 106 can introduce carrier gas into the fluidizing chamber 104 at different steady-state pressures and/or steady-state flow rates to affect a rate of particle delivery. The different steady-state pressures and/or steady-state flow rates can also affect the size of a fluidized zone within the fluidizing chamber 104. The fluidizing chamber 104 can be configured to contain the fluidized zone and, for this or another reason, the dimensions of the fluidizing chamber 104 can have some operational significance. For example, it can be useful to size the fluidizing chamber 104 so that the fluidized zone does not extend outside the fluidizing chamber 104 (e.g., into the particle-supply chamber 102) at a maximum pressure and/or flow rate of carrier gas. In some embodiments, the fluidizing chamber 104 has a length of at least about 10 cm between the inlet opening 118 and the metering assembly 106, such as at least about 20 cm or at least about 40 cm. The fluidizing chamber 104 can be configured to at least partially contain horizontal expansion of the fluidized zone. For example, changing the pressure and/or flow rate of the carrier gas can change the height of the fluidized zone and generally not change the width of the fluidized zone. In some embodiments, the fluidizing chamber 104 has a ratio of length to average width from about 2:1 to about 20:1, such as from about 3:1 to about 10:1 or from about 4:1 to about 6:1. Other suitable dimensions, including lengths and ratios of length to average width, are also possible depending on space limitations, the desired maximum particle flow rate, and other factors. In some embodiments, extension of a fluidized zone into the particle-supply chamber 102 can be acceptable or even desirable. For example, as discussed below with reference to FIG. 4, some embodiments do not include a fluidizing chamber 104 and have a metering assembly 106 directly connected to a particle-supply chamber 102.

As shown in FIG. 2, the metering assembly 106 can include a particle flow path 124 (represented by an arrow in FIG. 2) extending from the fluidizing chamber 104. Along the particle flow path 124 downstream from the metering opening 122, the metering assembly 106 can include a carrier-gas distributor 126, a shutoff valve 128, a vent 130 (best shown in FIG. 1), and a collector 132 (e.g., a cone or chute). The shutoff valve 128 can include a stopper 134 and an actuator 136. In some embodiments, the actuator 136 is pneumatic and defaults to a closed position. For example, the actuator 136 can include a pneumatic inlet 137 (FIG. 1) and a spring (not shown) that pushes the stopper 134 across the particle flow path 124 in the absence of pneumatic pressure. The shutoff valve 128 is shown fully open in FIG. 2, and can be configured to be either fully open or fully closed during steady-state operation. When the shutoff valve 128 is fully open, particles can travel along the particle flow path 124 by gravity and/or via a fluidizing carrier gas. After exiting the carrier-gas distributor 126, the particles can collect in the collector 132. Excess carrier gas can be vented through the vent 130. From the collector 132, the particles can be drawn through the outlet conduit 120, which can deliver the particles to a cutting head (not shown). In some embodiments, the collector 132 is configured to direct movement of particles into the outlet conduit 120, but not to stage particles prior to entering the outlet conduit 120. In other embodiments, the collector 132 can be configured to hold a small quantity of particles prior to entering the outlet conduit 120. In contrast to large agglomerations of particles, small agglomerations of particles typically behave in a more consistent and reliable manner. Accordingly, collecting small agglomerations of particles in the collector 132 can buffer fluctuations in the particle flow rate without necessarily compromising the consistency and reliability of overall particle delivery.

Figure 3:
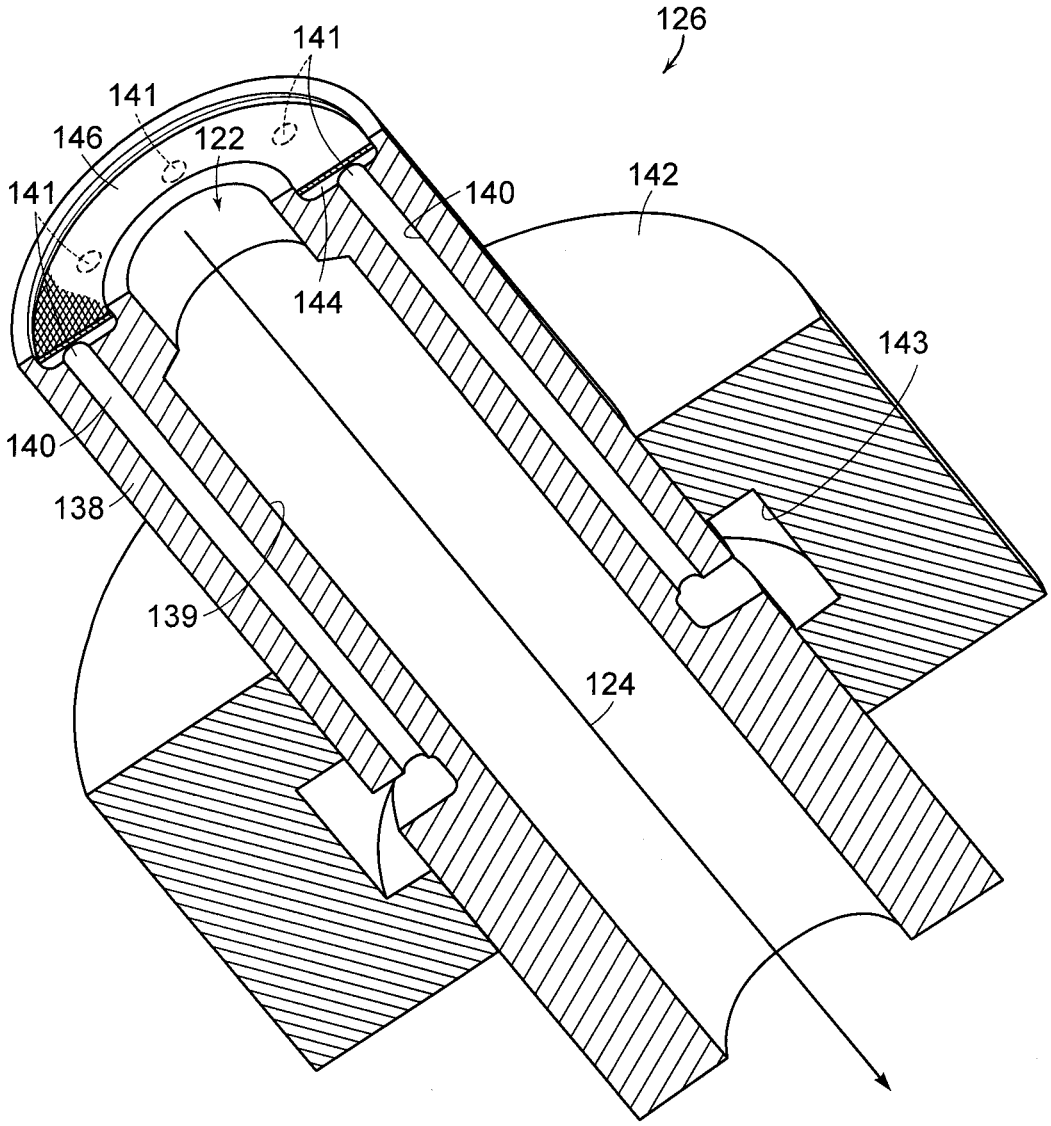
FIG. 3 is a cross-sectional perspective view of a carrier-gas distributor of the metering assembly shown in FIG. 2 together with associated structures.

FIG. 3 is a perspective view of the carrier-gas distributor 126 of the metering assembly 106. As shown in FIGS. 2-3, the metering assembly 106 can include a body 138 with a first end portion coupled to the fluidizing chamber 104 and a second end portion opposite to the first end portion and coupled to the shutoff valve 128. The body 138 can further include an intermediate portion between the first end portion and the second end portion. In some embodiments, the body 138 is elongated and has a longitudinal axis extending generally parallel to the particle flow path 124. For example, the body 138 can include a central bore 139 through which the particle flow path 124 can extend. The metering assembly 106 can further include a plurality of carrier-gas passages 140 extending through the body 138 generally parallel to and spaced radially outward from the longitudinal axis and the particle flow path 124. The carrier-gas passages 140 can have inlet portions at the intermediate portion of the body 138 and outlet portions at the first end portion of the body 138. More specifically, the carrier-gas passages 140 can extend to injection orifices 141 proximate the fluidizing chamber 104. The injection orifices 141 can be radially distributed around the metering opening 122.

The metering assembly 106 and the carrier-gas distributor 126 can also include a manifold 142 extending around the body 128 and defining a manifold chamber 143 fluidly connected to the carrier-gas passages 140 at the inlet portions of the carrier-gas passages 140. The manifold chamber 143 can be annular and can extend radially around the particle flow path 124. The metering assembly 106 can include eight carrier-gas passages 140 and corresponding injection orifices 141, with two carrier-gas passages 140 and five injection orifices 141 shown in FIG. 3. In other embodiments, the metering assembly 106 can include a different number of carrier-gas passages 140 and injection orifices 141. Furthermore, the carrier-gas passages 140 and injection orifices 141 can have different configurations. For example, one or more injection orifices 141 can be positioned on a lateral portion of the fluidizing chamber 104. As another example, the injection orifices 141 can connect directly to the manifold chamber 143 with no intervening carrier-gas passages 140. In some embodiments, distributing the carrier-gas injection, e.g., generally symmetrically around the metering opening 122, can improve the flow characteristics of the fluidized particles. For example, distributing the carrier-gas injection can reduce turbulence in the fluidized zone and/or improve the correlation between the steady-state pressure and/or steady-state flow rate of the injected carrier gas and the flow rate of particles exiting the fluidizing chamber 104.

As best shown in FIG. 3, the carrier-gas distributor 126 can include an annular recess 144 aligned with the injection orifices 141, and the metering assembly 106 can include a screen 146 within the recess 144. The screen 146 can be integral or detachable from other portions of the metering assembly 106. In some embodiments, the screen 146 can be replaceable during routine maintenance of the metering assembly 106. The screen 146 can be configured to allow passage of carrier gas and to prevent passage of particles. This can be useful, for example, to reduce settling of particles into the carrier-gas passages 140 when the metering assembly 106 is directly below the fluidizing chamber 104. The screen 146 can be Dutch woven or have another suitable weave or other form. The mesh size of the screen 146 can be selected according to the minimum particle size to be introduced into the fluidizing chamber 104. For example, the screen 146 can have an average opening size between about 1 micron and about 200 microns, such as between about 2 microns and about 100 microns, or another suitable mesh size. In addition to or instead of serving to exclude particles from the carrier-gas passages 140, the screen 146 can promote distribution of injected carrier gas. In some embodiments, a gap can be present between the screen 146 and the bottom of the recess 144. This gap can be permanent or temporarily formed during operation. For example, the screen 146 can have vertical play within the recess 144 and the recess 144 can have an upper flange (not shown) that holds the screen 146 in an elevated position against upward pressure from carrier gas exiting the injection orifices 141.

With reference again to FIG. 2, the metering assembly 106 can include a regulator 148 configured to change the steady-state pressure and/or flow rate of carrier gas entering the fluidizing chamber 104 through the manifold chamber 143 and the carrier-gas passages 140. As shown in FIG. 2, the regulator 148 can be along a conduit 150 extending between a carrier-gas source 152 and the manifold 142. The carrier-gas distributor 126 can include a port 153 (FIG. 1) connectable to the conduit 150. In some embodiments, the carrier-gas source 152 is a tank external or internal to a machine housing (not shown). The carrier-gas source 152 can also be a common gas supply, such as a common pneumatic supply line of a production facility. Together, the portions of the metering assembly 106 that convey carrier gas can act as a carrier-gas injector configured to inject carrier gas into the fluidizing chamber 104. Correspondingly, the regulator 148 can be configured to change the steady-state pressure and/or flow rate of carrier gas exiting the carrier-gas injector. The regulator 148 can include a valve 154, e.g., a precision needle valve, and an actuator 156, e.g., a manual or automatic actuator. Operation of the regulator 148 is further discussed below with reference to FIGS. 6-7.

Figure 4:
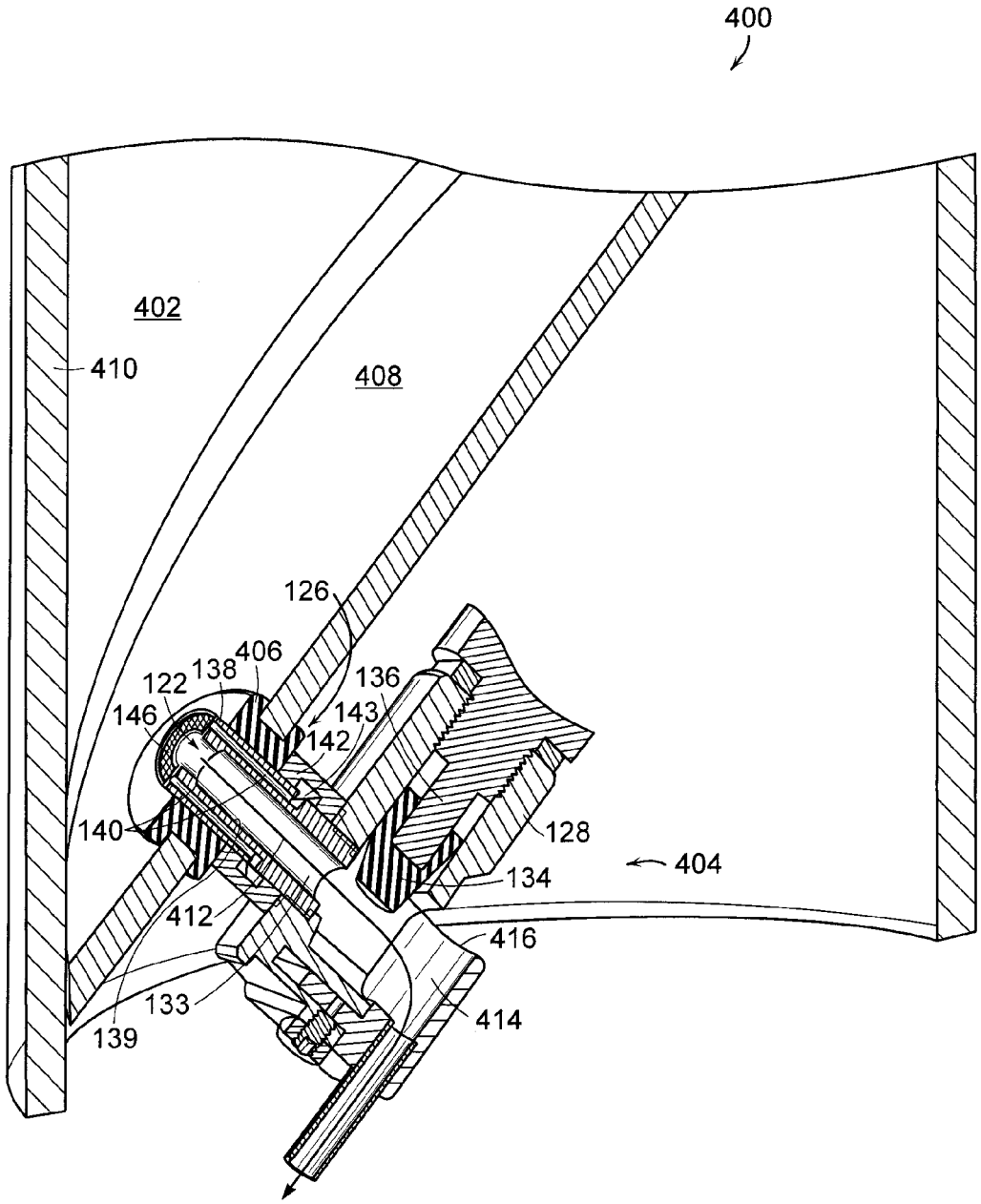
FIG. 4 is a cross-sectional perspective view of a particle-delivery device of an abrasive-jet system configured in accordance with another embodiment of the present technology and having a metering assembly directly connected to a particle-supply chamber.

FIG. 4 is a cross-sectional perspective view of a particle-delivery device 400 configured in accordance with another embodiment of the present technology. The particle-delivery device 400 can include a particle-supply chamber 402 and a metering assembly 404. The particle-delivery device 400 is generally similar in structure and function to the particle-delivery device 100 shown in FIG. 1. For example, the particle-delivery device 400 includes a particle-supply chamber 402 and a metering assembly 404. In the illustrated embodiment, however, the particle-delivery device 400 does not include a fluidizing chamber between the particle-supply chamber 402 and the metering assembly 404. Instead, the metering assembly 404 can be directly connected to the particle-supply chamber 402. In particular, the metering assembly 404 can include a flanged connector 406, the particle-supply chamber 402 can include a plate 408 set at an angle within a cylindrical housing 410, and the flanged connector 406 can be connected to the plate 408. In the embodiment shown in FIG. 4, the metering assembly 404 can be connected to the particle-supply chamber 402 at a lower portion of the particle-supply chamber 402 near an intersection between the plate 408 and the cylindrical housing 410. In some embodiments, the lowermost portion of the particle-supply chamber 402 can contain the fluidized zone during operation. The metering assembly 404 includes a particle flow path 412, a collector 414, and a vent 416 that differ from the particle flow path 124, the collector 132, and the vent 130 of the metering assembly 106 shown in FIG. 2. For example, the collector 414 can be configured to change the angle of the particle flow path 412 between the carrier-gas distributor 126 and the outlet conduit 120. As shown in FIG. 4, the collector 414 can be at least partially cylindrical with the vent 416 at one end of the collector 414, the outlet conduit 120 at an opposite end of the collector 414, and the particle flow path 412 extending into the collector 414 laterally between the vent 416 and the outlet conduit 120.

Figure 5B:
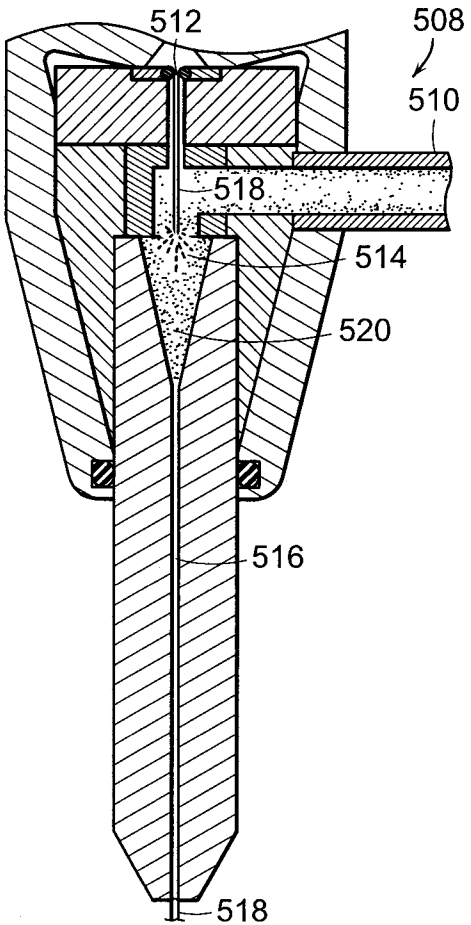
FIG. 5B is an enlarged, cross-sectional view of a cutting head and a portion of an associated conduit of the abrasive-jet system shown in FIG. 5A.
Figure 5A:
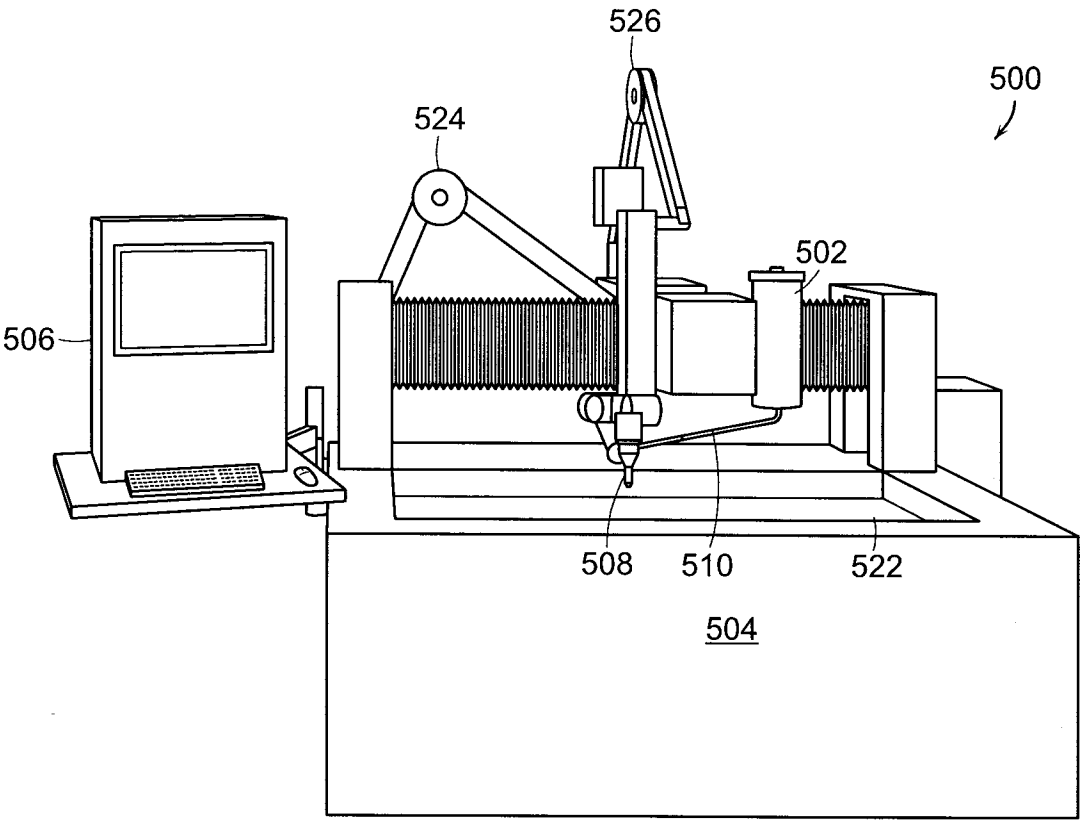
FIG. 5A is a perspective view of an abrasive jet system configured in accordance with an embodiment of the present technology and including a particle-delivery device similar to the particle-delivery device shown in FIG. 1.

FIG. 5A is a perspective view of an abrasive jet system 500 that can include a particle-delivery device 502 configured in accordance with an embodiment of the present technology. For example, the particle-delivery device 502 can be similar to the particle-delivery device 400 shown in FIG. 4 or similar to the particle-delivery device 100 shown in FIG. 1, except with the cylindrical housing 116 extended downward beyond the metering assemblies 106 and with the outlet conduits 120 merged into a single conduit. The particle-delivery device 502 can be original to or a retrofit of the abrasive-jet system 500. In addition to the particle-delivery device 502, the abrasive-jet system 500 can include a base 504, a user interface 506, a cutting head 508, and a conduit 510 extending between the particle-delivery device 502 and the cutting head 508. For simplicity, FIG. 5A does not show a fluid source, a pump, or an intensifier, which can be operably connected to the cutting head 508.

FIG. 5B is an enlarged, cross-sectional view of the cutting head 508 and a portion of the conduit 510 shown in FIG. 5A. As shown in FIG. 5B, the cutting head 508 can include a jet orifice 512, a mixing chamber 514 downstream from the jet orifice 512, and an abrasive jet passage 516 downstream from the mixing chamber 514. A jet 518 and abrasive particles are shown in FIG. 5B to illustrate operation. During operation, the conduit 510 can deliver abrasive particles to the mixing chamber 514 and the abrasive particles can concentrate in a tapered portion 520 of the mixing chamber 514. The abrasive particles can become entrained in the jet 518 as it passes through the tapered portion 520 prior to entering the abrasive-jet passage 516. Within the abrasive-jet passage 516, the abrasive particles can accelerate with the jet 518 before being directed toward a workpiece (not shown). The workpiece can be held in a jig (not shown) over the base 504 (FIG. 5A). As shown in FIG. 5A, the base 504 can include a diffusing tray 522 configured to diffuse energy of the jet 518 after it passes through the workpiece. The abrasive jet system 500 can also include an x-axis robotic arm 524 and a y-axis robotic arm 526 configured to move the particle-delivery device 502, the cutting head 508, and the conduit 510 to different positions within a plane over the diffusing tray 522.

Figure 6:
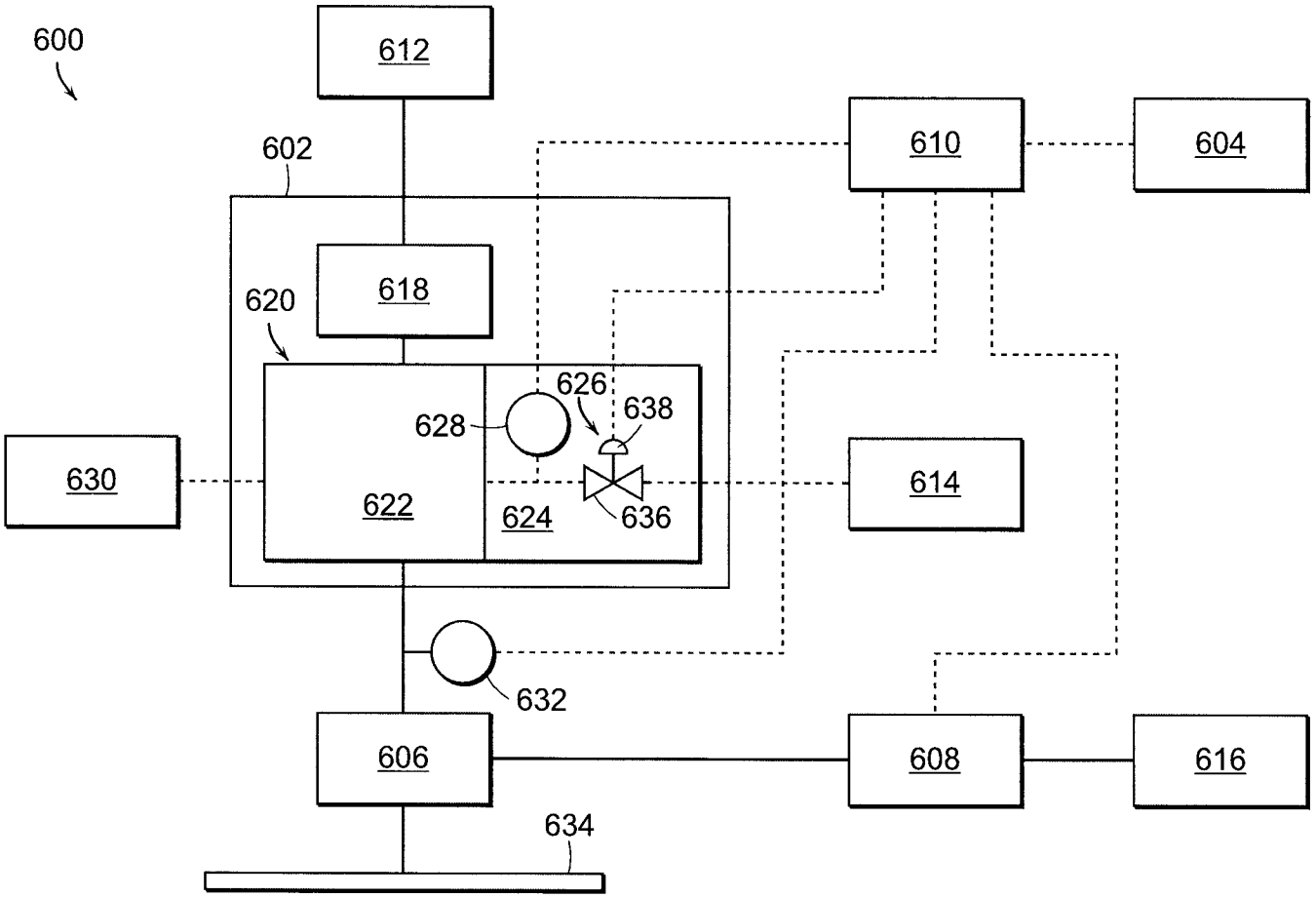
FIG. 6 is a schematic diagram illustrating control, monitoring, and other features of an abrasive-jet system configured in accordance with an embodiment of the present technology and having elements configured to control a pressure and/or flow rate of injected carrier gas.

FIG. 6 is a schematic diagram illustrating control, monitoring, and other features of an abrasive-jet system 600 configured in accordance with an embodiment of the present technology. The abrasive-jet system 600 can include a particle-delivery device 602, a user interface 604, a cutting head 606, a fluid-pressurizing device 608, and a controller 610. The particle-delivery device 602 can be similar, for example, to the particle-delivery device 100 shown in FIG. 1. FIG. 6 also illustrates consumable-material sources that can be external or internal to the abrasive jet system 600. The consumable-material sources can include a particle source 612, a carrier-gas source 614, and a fluid source 616. During operation, the particle-delivery device 602 can receive particles from the particle source 612. The particle-delivery device 602 can include a particle-supply chamber 618 and a fluidizing-and-metering assembly 620 with a main portion 622 and a control-and-monitoring portion 624. Particles from the particle source 612 can be routed first into the particle-supply chamber 618 and then into the main portion 622.

The control-and-monitoring portion 624 can include a regulator 626 and a first sensor 628 configured, respectively, to regulate and monitor the pressure and/or flow rate of carrier gas traveling from the carrier-gas source 614 to the main portion 622. In some embodiments, the control-and-monitoring portion 624 is proximate the main portion 622. In other embodiments, the control-and-monitoring portion 624 is distant from the main portion 622. For example, the control-and-monitoring portion 624 can be closer to the carrier-gas source 614 than to the main portion 622. With reference to FIG. 6, carrier gas exiting the main portion 622 can be vented to an exhaust destination 630, which can be, for example, the atmosphere or a container. The main portion 622 and/or the exhaust destination 630 can include a filter (not shown) configured to block passage of at least a portion of any particles entrained in the vented carrier gas. Moreover, in some embodiments, the exhaust destination 630 is fluidly connected to the carrier-gas source 614 and the abrasive-jet system 600 is configured to recycle the carrier gas. After exiting the main portion 622, a metered flow of particles can be routed to the cutting head 606 where the particles can be combined with pressurized fluid from the fluid-pressurizing device 608 and the fluid source 616. The abrasive-jet system 600 can include a second sensor 632 configured to monitor the flow rate of the metered flow of particles. FIG. 6 also shows a workpiece 634 proximate the cutting head 606.

The user interface 604, the fluid-pressurizing device 608, the first sensor 628, the regulator 626, and the second sensor 632 can be operably coupled to and configured to communicate with the controller 610. In some embodiments, the controller 610 is configured to change the flow rate of particles exiting the main portion 622, e.g., through a metering opening (not shown) of the main portion 622, by adjusting the regulator 626. For example, the regulator 626 can include a valve 636 and an actuator 638. The actuator 638 can be a solenoid actuator or another type of automatic actuator and the controller 610 can be configured to send a signal to the actuator 638 to move the valve 636. A correlation between moving the valve 636 and the particle flow rate can be programmed into the controller 610. In addition or alternatively, the controller 610 can be configured to adjust the regulator 626 based at least in part on data from the first and second sensors 628, 632. For example, the abrasive jet system 600 can include a control loop including the first sensor 628, the controller 610, and the regulator 626 and/or a control loop including the second sensor 632, the controller 610, and the regulator 626. The controller 610 can control other parameters of the abrasive-jet system 600 in conjunction with the flow rate of particles exiting the main portion 622. For example, the main portion 622 can include a collector (not shown) similar to the collector 132 shown in FIG. 2 and the controller 610 can be configured to maintain a general level of particles in the collector. The controller 610 can also be configured to control operation of the fluid-pressurizing device 608.

The user interface 604 can be configured to receive a command corresponding to a desired particle flow rate. The command, for example, can be an abrasive-jet setting, such as a jet diameter or a jet speed. The controller 610 can be programmed with rates of particle consumption desirable for various settings. For example, larger-diameter abrasive jets and faster abrasive jets typically call for greater rates of particle consumption. The command also can be a direct command for a particle-delivery rate, a carrier-gas flow rate, or a carrier-gas pressure. The regulator 626 and the first and second sensors 628, 632 can be configured to send signals to the user interface 604, e.g., via the controller 610, and the user interface 604 can be configured to display data corresponding to the signals. Based on the display, a user may use the user interface 604 to instruct the controller 610 to increase or decrease the particle-delivery rate, the carrier-gas flow rate, or the carrier-gas pressure, such as to increase or decrease the rate of erosion occurring on the workpiece 634. In some embodiments, the user interface 604 has a minimum-consumption setting corresponding to a minimum, non-zero rate of particle consumption. At the minimum-consumption setting, the controller 610 can be configured to adjust and/or maintain the regulator 626 so that no carrier gas flows to the main portion 622 or so that carrier gas flows to the main portion 622 at a pressure and flow rate generally insufficient to fluidize particles exiting the main portion 622.

Figure 7:
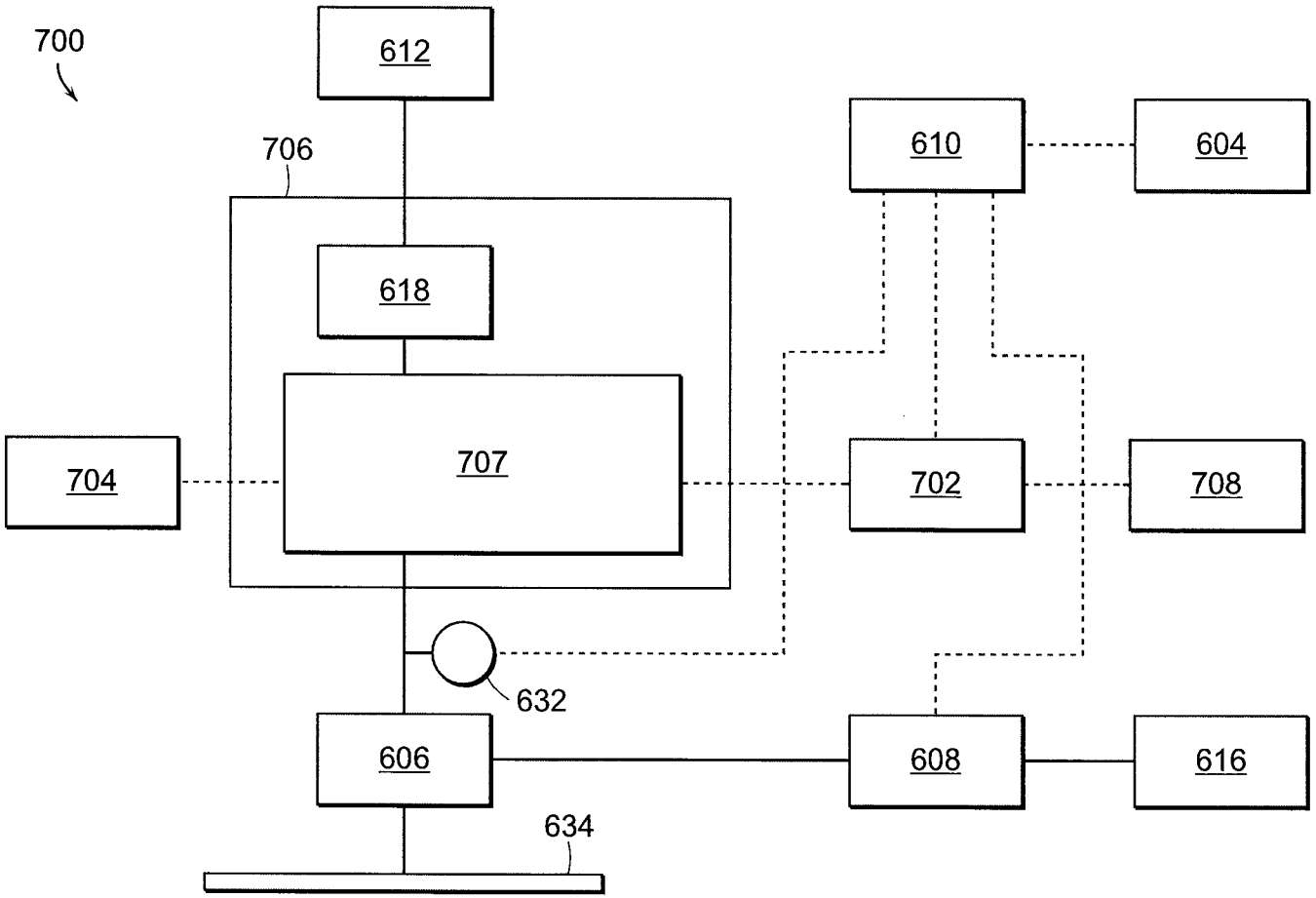
FIG. 7 is a schematic diagram illustrating control, monitoring, and other features of an abrasive-jet system configured in accordance with another embodiment of the present technology and having elements configured to control a pressure and/or flow rate of vented carrier gas.

In addition to or instead of controlling the steady-state pressure and/or steady-state flow rate of carrier gas entering the main portion 622, the abrasive-jet system 600 can be configured to control the steady-state pressure and/or steady-state flow rate of carrier gas exiting the main portion 622. FIG. 7 is a schematic diagram of an abrasive-jet system 700 configured in accordance with another embodiment of the present technology. The abrasive jet system 700 is similar to the abrasive-jet system 600 shown in FIG. 6, except that it includes a suction source 702 in place of the carrier-gas source 614 (FIG. 6) and a carrier-gas source 704 in place of the exhaust destination 630 (FIG. 6). The abrasive-jet system 700 also includes a particle-delivery device 706 and a fluidizing-and-metering assembly 707 similar, respectively, to the particle-delivery device 602 and fluidizing-and-metering assembly 620 shown in FIG. 6, but without a control-and-monitoring portion 624 (FIG. 6). In some embodiments, a sensor (not shown) can be included upstream from the suction source 702 to monitor the level of suction from the suction source 702. Such a sensor can be incorporated into a control loop with the suction source 702 and the controller 610. FIG. 7 also shows an exhaust destination 708 downstream from the suction source 702. Similar to the exhaust destination 630 shown in FIG. 6, the exhaust destination 708 can be, for example, the atmosphere or a container.

The fluidizing-and-metering assembly 707 can be configured to receive carrier gas from the carrier-gas source 704 and to vent the carrier gas at a variable rate to the carrier-gas destination 708 via the suction source 702. The suction source 702 can be configured to receive a signal from the controller 610 to adjust the level of suction. This can change the flow rate of particles exiting the fluidizing-and-metering assembly 707. For example, the fluidizing-and-metering assembly 707 can include a vent (not shown) similar to the vent 130 shown in FIG. 2. The vent can be connected, e.g., sealingly connected, to the suction source 702. Changing the level of suction can draw more fluidized particles through a metering opening (not shown) of the fluidizing-and-metering assembly 707. The carrier-gas source 704 can be configured to supply carrier gas in response to changes in the flow rate of fluidized particles that the suction source 702 initiates. For example, the abrasive-jet system 700 can include a pressure-compensated flow regulator (not shown) downstream from the carrier-gas source 704. In some embodiments, the suction source 702 and the carrier-gas destination 708 can be eliminated and a Venturi effect associated with a jet passing through the cutting head 606 can provide variable suction. In still other embodiments, the carrier-gas source 704 can be eliminated or replaced with an intake vent (not shown) and variable suction can be used to draw non-fluidized particles through a metering opening at a variable flow rate.

With reference to FIGS. 6-7, the particle-delivery devices 602, 706 and other particle-delivery devices configured in accordance with embodiments of the present technology can be more dynamic and responsive than at least some conventional particle-delivery devices. For example, in some embodiments, after a command is entered into the user interface 604, the quantity of particles within a jet exiting the cutting head 606 can change according to the command and return to steady state in less than about 5 seconds, such as less than about 3 seconds or less than about 1 second. Furthermore, the controllable increments of particle-delivery rate can be relatively small, such as less than about 0.2 kg/min, less than about 0.1 kg/min, or les than about 0.05 kg/min. Specified particle-delivery rates can also be provided with a high degree of precision. For example, at a given particle-delivery rate, e.g., either directly specified or corresponding to another specified parameter, embodiments of the present technology achieve the particle-delivery rate at steady state with variability less than about 0.05 kg/min, such as less than about 0.03 kg/min or less than about 0.01 kg/min. In some embodiments, a correlation between particle-delivery rate and carrier-gas pressure and/or flow rate is generally independent of the loading of the particle-supply chamber 618. For example, average variability in the correlation can be less than about 10%, such as less than about 5% or less than about 3%, when the particle-supply chamber 618 is loaded between about 25% and about 100% of its capacity.

Figure 8:
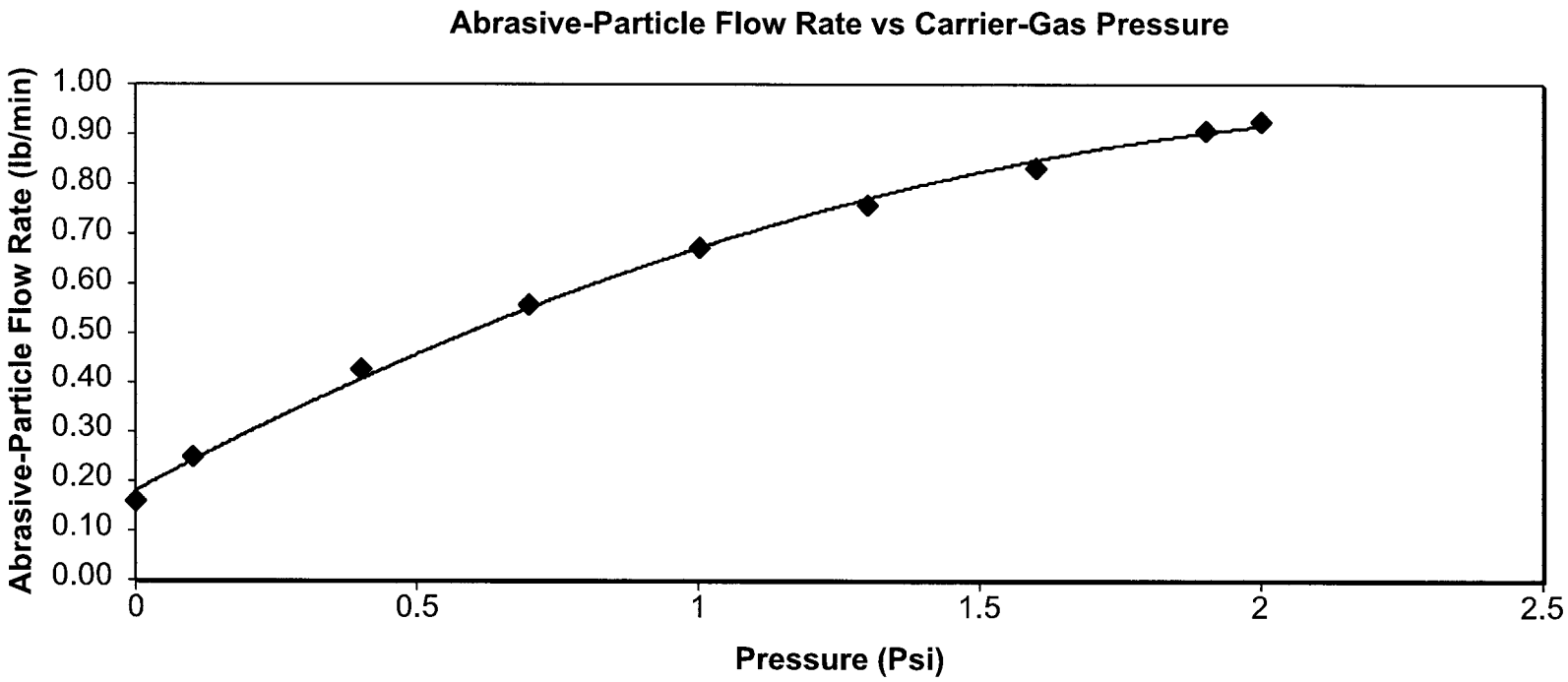
FIG. 8 is a plot of abrasive-particle flow rate (y-axis) versus carrier-gas pressure (x-axis) for trials of an experimental system configured in accordance with an embodiment of the present technology.
Figure 9:
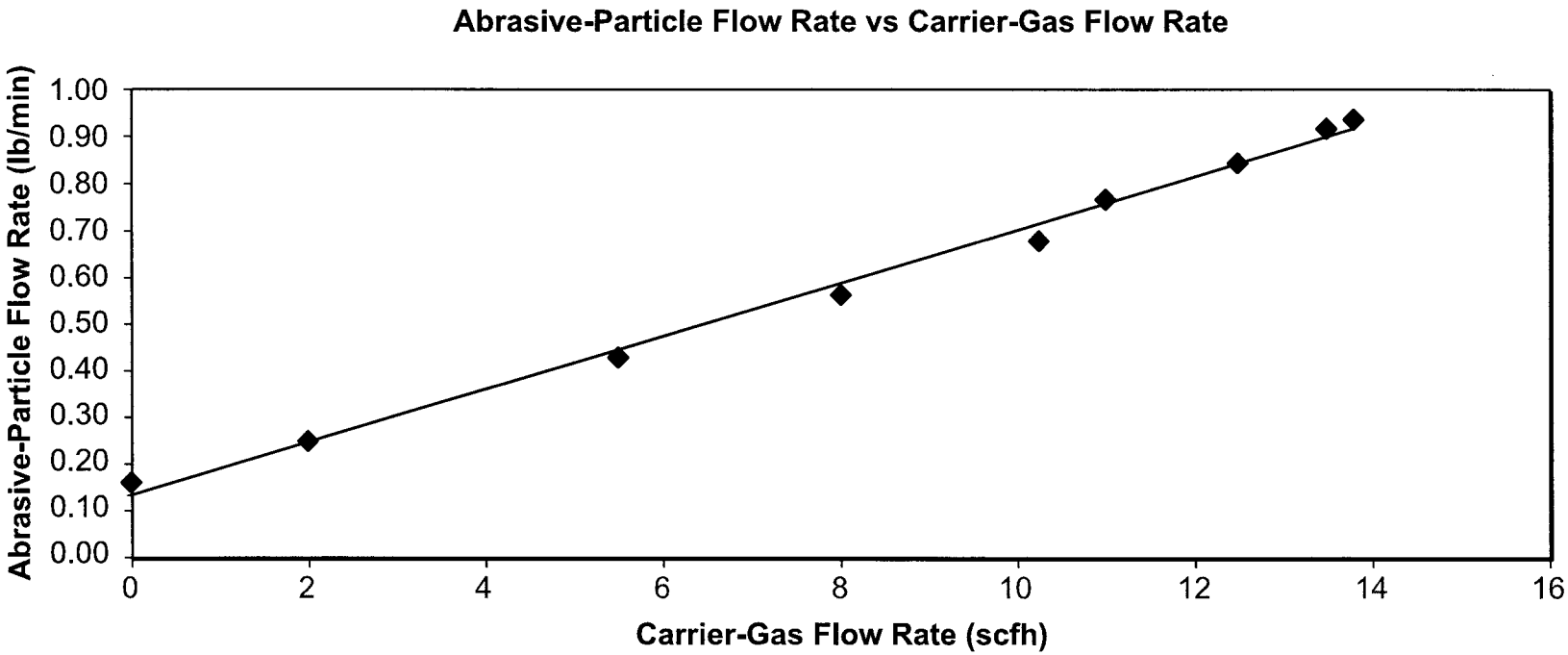
FIG. 9 is a plot of abrasive-particle flow rate (y-axis) versus carrier-gas flow rate (x-axis) for the trials represented in FIG. 8.

FIGS. 8-9 are plots of data gathered from trials of an experimental system configured in accordance with an embodiment of the present technology. Specifically, FIG. 8 is a plot of abrasive-particle flow rate versus carrier-gas pressure and FIG. 9 is a plot of abrasive-particle flow rate versus carrier-gas flow rate. The experimental system included a metering orifice having an inner diameter of 0.128 inches. The trials resulting in the data shown in FIGS. 8-9 were performed with #50 mesh particles. As shown in FIGS. 8-9, the baseline particle flow rate was about 0.15 lb/min. When fluidized with carrier gas at pressures up to about 2 psi (FIG. 8) and flow rates up to about 14 scfh (FIG. 9), the particle flow rate increased proportionally and regularly up to about 0.9 lb/min. As shown in FIG. 9, the correlation between abrasive-particle flow rate and carrier-gas flow rate for the trials was approximately linear. Among other features of the present technology, FIGS. 8-9 illustrate the precision in particle-delivery rate that embodiments of the present technology can achieve.

This disclosure is not intended to be exhaustive or to limit the present technology to the precise forms disclosed herein. Although specific embodiments are disclosed herein for illustrative purposes, various equivalent modifications are possible without deviating from the present technology, as those of ordinary skill in the relevant art will recognize. In some cases, well-known structures and functions have not been shown or described in detail to avoid unnecessarily obscuring the description of the embodiments of the present technology. Although steps of methods may be presented herein in a particular order, alternative embodiments may perform the steps in a different order. Similarly, certain aspects of the present technology disclosed in the context of particular embodiments can be combined or eliminated in other embodiments. Furthermore, while advantages associated with certain embodiments of the present technology may have been disclosed in the context of those embodiments, other embodiments can also exhibit such advantages, and not all embodiments need necessarily exhibit such advantages or other advantages disclosed herein to fall within the scope of the technology. Accordingly, the disclosure and associated technology can encompass other embodiments not expressly shown or described herein.

We claim:

1. A particle-delivery device, comprising:

a hopper configured to contain abrasive particles;

an elongate fluidizing chamber having a first end portion and an opposite second end portion, wherein the fluidizing chamber is positioned to receive abrasive particles from the hopper via the first end portion; and a metering assembly operably connected to the fluidizing chamber, wherein the metering assembly includes:

a metering opening at the second end portion of the fluidizing chamber, an injection orifice at the second end portion of the fluidizing chamber, a regulator configured to change a steady-state pressure, a steady-state flow rate, or both of carrier gas entering the fluidizing chamber via the injection orifice, a collector downstream from the metering opening, and a vent downstream from the metering opening and upstream from the collector, wherein the vent is configured to vent carrier gas from the metering assembly such that abrasive particles carried by the vented carrier gas settle into the collector.

2. The particle-delivery device of claim 1, wherein:

the fluidizing chamber has a length from the hopper at the first end portion of the fluidizing chamber to the metering assembly at the second end portion of the fluidizing chamber;

the fluidizing chamber has an average width perpendicular to its length; and a ratio of the length of the fluidizing chamber to the average width of the fluidizing chamber is within a range from 3:1 to 10:1.

3. The particle-delivery device of claim 1, wherein the metering assembly includes a shutoff valve downstream from the metering opening and upstream from the vent.

4. The particle-delivery device of claim 1, further comprising a screen at the injection orifice.

5. The particle-delivery device of claim 4, wherein the screen is configured to shift away from the injection orifice when carrier gas flows through the injection orifice.

6. The particle-delivery device of claim 1, further comprising: a controller operably connected to the regulator, wherein the controller is configured to change a flow rate of abrasive particles through the metering opening by adjusting the regulator.

7. The particle-delivery device of claim 6, wherein the controller is configured to maintain a supply of abrasive particles in the collector by adjusting the regulator.

8. The particle-delivery device of claim 1, wherein the collector includes a chute.

9. The particle-delivery device of claim 1, wherein the fluidizing chamber is a drop tube that extends downward from a lower portion of the hopper.

10. The particle-delivery device of claim 9, wherein:

the fluidizing chamber is at a first portion of a drop tube that extends downward from a lower portion of the hopper; and the metering assembly includes a carrier gas distributor within a second portion of the drop tube downstream from the first portion of the drop tube.

11. A particle-delivery device, comprising:

a hopper configured to contain abrasive particles;

an elongate fluidizing chamber having a first end portion and an opposite second end portion, wherein the fluidizing chamber is positioned to receive abrasive particles from the hopper via the first end portion;

an outlet conduit downstream from the fluidizing chamber, wherein abrasive particles travel along a flow path extending from the fluidizing chamber to the outlet conduit; and a metering assembly positioned along the flow path between the fluidizing chamber and the outlet conduit, wherein the metering assembly includes:

a metering opening at the second end portion of the fluidizing chamber, a plurality of injection orifices, wherein individual injection orifices within the plurality of injection orifices are distributed around the metering opening at the second end portion of the fluidizing chamber, a regulator configured to change a steady-state pressure, a steady-state flow rate, or both of carrier gas entering the fluidizing chamber via the plurality of injection orifices, and a manifold chamber extending around the flow path, wherein the manifold chamber is configured to distribute carrier gas among the individual injection orifices.

12. The particle-delivery device of claim 11, further comprising a plurality of carrier-gas passages, wherein individual carrier-gas passages of the plurality of carrier-gas passages extend between the manifold chamber and the individual injection orifices, respectively.

13. The particle-delivery device of claim 12, wherein the carrier-gas passages are parallel to the flow path.

14. The particle-delivery device of claim 11, further comprising a screen adjacent to the plurality of injection orifices.

15. The particle-delivery device of claim 14, wherein the screen is configured to shift away from the plurality of injection orifices when carrier gas flows through the plurality of injection orifices.

16. The particle-delivery device of claim 11, further comprising a controller operably connected to the regulator, wherein the controller is configured to change a flow rate of abrasive particles through the metering opening by adjusting the regulator.

17. The particle-delivery device of claim 11, wherein the metering assembly further comprises:

a collector downstream from the metering opening, and a vent downstream from the metering opening and upstream from the collector, wherein the vent is configured to vent carrier gas from the metering assembly such that abrasive particles carried by the vented carrier gas settle into the collector.

18. The particle-delivery device of claim 17, wherein the metering assembly includes a shutoff valve downstream from the metering opening and upstream from the vent.

19. The particle-delivery device of claim 11, wherein the fluidizing chamber is a drop tube that extends downward from a lower portion of the hopper.

20. The particle-delivery device of claim 19, wherein:

the fluidizing chamber is at a first portion of a drop tube that extends downward from a lower portion of the hopper; and the metering assembly includes a carrier-gas distributor within a second portion of the drop tube downstream from the first portion of the drop tube.

21. A method of supplying abrasive particles to an abrasive jet, the method comprising:

flowing a first quantity of non-fluidized abrasive particles at a first steady-state flow rate from a container through a metering opening of a metering assembly operably connected to the container;

introducing carrier gas at a first carrier-gas pressure and a first carrier-gas flow rate into a second quantity of abrasive particles within the container to fluidized the second quantity of abrasive particles;

flowing the second quantity of abrasive particles at a second steady-state flow rate from the container through the metering opening while the second quantity of abrasive particles is fluidized;

introducing carrier gas at a second carrier-gas pressure and a second carrier-gas flow rate into a third quantity of abrasive particles within the container to fluidized the third quantity of abrasive particles; and flowing the third quantity of abrasive particles at a third steady-state flow rate from the container through the metering opening while the third quantity of abrasive particles is fluidized, wherein:

the second carrier-gas pressure is greater than the first carrier-gas pressure, the second carrier-gas flow rate is greater than the first carrier-gas flow rate, or both, and the first, second, and third steady-state flow rates are different.

22. The method of claim 21, wherein the second steady-state flow rate is greater than the first steady-state flow rate; and the third steady-state flow rate is greater than the second steady-state flow rate.

23. The method of claim 21, wherein flowing the first quantity of abrasive particles through the metering opening includes opening a shutoff valve of the metering assembly to allow the first quantity of abrasive particles to move through the metering opening by gravity.

24. A method of supplying abrasive particles to an abrasive jet, the method comprising:

moving abrasive particles from a hopper into an elongate fluidizing chamber operably connected to the hopper;

injecting carrier gas into the fluidizing chamber to fluidize abrasive particles within the fluidizing chamber while other abrasive particles within the fluidizing chamber upstream from the fluidized abrasive particles are non-fluidized;

flowing fluidized abrasive particles from the fluidizing chamber through a metering opening of a metering assembly operably connected to the fluidizing chamber; and operating a regulator to change a steady-state pressure, a steady-state flow rate, or both of carrier gas injected into the fluidizing chamber to change a flow rate of abrasive particles moving through the metering opening.

25. The method of claim 24, wherein:

injecting carrier gas into the fluidizing chamber forms a fluidized zone within a lowermost portion of the fluidizing chamber; and changing the steady-state pressure, the steady-state flow rate, or both of carrier gas injected into the fluidizing chamber changes a height of the fluidized zone and does not change a width of the fluidized zone.

26. The method of claim 24, further comprising venting carrier gas from the metering assembly via a vent downstream from the metering opening such that abrasive particles carried by the vented carrier gas settle into a collector downstream from the vent.

27. The method of claim 26, further comprising drawing abrasive particles from the collector into an abrasive jet by a Venturi effect.

28. The method of claim 26, wherein venting carrier gas from the metering assembly via the vent such that abrasive particles carried by the vented carrier gas settle into the collector includes venting carrier gas from the metering assembly via the vent such that abrasive particles carried by the vented carrier gas settle into a chute downstream from the vent.

29. The method of claim 24, wherein changing the flow rate of abrasive particles moving through the metering opening includes changing the flow rate of abrasive particles moving through the metering opening to maintain a supply of abrasive particles in a collector downstream from the metering opening.

30. The method of claim 24, wherein moving abrasive particles from the hopper into the fluidizing chamber includes moving abrasive particles by gravity from the hopper into a drop tube that extends downward from a lower portion of the hopper.

31. The method of claim 30, wherein injecting carrier gas into the fluidizing chamber includes injecting carrier gas into the fluidizing chamber via a carrier-gas distributor within the drop tube.

32. The method of claim 24, wherein:

flowing fluidized abrasive particles from the fluidizing chamber through the metering opening includes flowing fluidized abrasive particles from the fluidizing chamber through the metering opening in a first direction; and injecting carrier gas into the fluidizing chamber includes injecting carrier gas into the fluidizing chamber in a second direction opposite to the first direction.

* * * * *